United States Patent [19]

Rieser

[11] Patent Number: 4,672,778

[45] Date of Patent: Jun. 16, 1987

[54] ROLLABLE KNIFE SHARPENER

[76] Inventor: Udo Rieser, Taunusring 28, D-6200 Wiesbaden Delkenheim, Fed. Rep. of Germany

[21] Appl. No.: 837,655

[22] Filed: Mar. 6, 1986

Related U.S. Application Data

[63] Continuation of Ser. No. 744,905, Jun. 17, 1985, abandoned, which is a continuation of Ser. No. 552,141, Sep. 27, 1983, abandoned.

[30] Foreign Application Priority Data

Jan. 28, 1982 [DE] Fed. Rep. of Germany ..... 3202742

[51] Int. Cl.[4] ..... B24D 15/08

[52] U.S. Cl. ..... 51/354; 51/210; 51/295; 51/111 R

[58] Field of Search ..... 51/210, 111 R, 112, 51/113, 114, 295, 330, 354, DIG. 6; 76/84

[56] References Cited

U.S. PATENT DOCUMENTS

| | | | |
|---|---|---|---|
| 466,293 | 12/1891 | Peer | 51/354 |
| 2,420,814 | 5/1947 | Clark | 51/354 X |
| 2,469,797 | 5/1949 | Thompson | 51/210 |
| 2,567,941 | 9/1951 | Karlstrom | 51/111 R X |
| 2,646,653 | 7/1953 | Murchison | 51/354 |
| 2,900,768 | 8/1959 | MacFarland | 51/197 |
| 3,032,938 | 5/1962 | Voll | 51/210 |
| 4,102,085 | 7/1978 | Church et al. | 51/295 |

FOREIGN PATENT DOCUMENTS 502162 3/1971 Switzerland .

*Primary Examiner*—Robert P. Olszewski
*Attorney, Agent, or Firm*—Oblon, Fisher, Spivak, McClelland & Maier

[57] ABSTRACT

Knife sharpener rollable on a support and having two substantially coaxially disposed equally sized rollers (2,4) pressed resiliently against each other. The rollers have on their facing sides externally conical intermeshing toothed rings (32) which consist at least at their facing faces (38) of a durable grinding material. The knife blade to be sharpened is introduced between the two toothed rings, the latter being pressed apart in the respective region. The grinding action is effected by the relative movement of the end faces of the toothed rings with respect to the blade drawn or pushed through, while the knife sharpener rolls on the support.

20 Claims, 2 Drawing Figures

ROLLABLE KNIFE SHARPENER

This application is a continuation of application Ser. No. 774,905, filed June 17, 1985, which is a continuation of application Ser. No. 552,141, filed Sept. 27, 1983, now abandoned.

BACKGROUND OF THE INVENTION

1. Field of the Invention

The invention relates to a knife sharpener rollable on a support.

2. Description of the Related Art

In a knife sharpener of the type known from U.S. Pat. No. 2,469,797, a regular grinding disc is enclosed resiliently between the two rollers whilst the respective support surfaces are formed by conical metal caps in the hub region of the rollers. The situation is similar in knife sharpeners according to U.S. Pat. Nos. 2,498,018 and 3,691,700 with the differences that, in the devices disclosed therein, the rollers on both sides are not subjected to any spring force, and the support surfaces are integrated in the two rollers. In each case, the knife blade to be sharpened is drawn in corresponding inclined position in succession through the two substantially V-shaped slots on the left and right of the grinding disc while the knife sharpener rolls on the support (for example, a table). The respective flank of the grinding disc slides in considerably varying direction on the cutting edge to be sharpened, giving a sharpening which is not very durable. In addition, the necessity of sharpening the blade in two successive operations in which it must additionally be held in opposite inclined positions has proved disadvantageous.

On the other hand, in the knife sharpeners disclosed in BE-PS No. 556,718 and DE-GM No. 1,867,319, grinding discs are disposed in pairs and pressed resiliently against each other and have intermeshing toothed rings on their end faces. The toothed rings form a V-shaped gap therebetween the peripheries of which are inclined with respect to each other. The knife blade to be sharpened in drawn through said gap whilst the grinding discs are driven separately therefrom. In this case, although only a single operation is necessary for the sharpening, the grind obtained with a grinding direction running parallel to the cutting edge is again not very durable.

OBJECT OF THE INVENTION

The invention is based on the problem of providing a knife sharpener which is simple and simple to use and which gives a more permanent sharpening.

SUMMARY OF THE INVENTION

According to the invention, intermeshing toothed rings (which are known per se) are used in novel manner which does not allow any tangentially directed relative motion to occur between the knife blade and the toothed ring. Contrary to expectation, it has been found that even the small radially directed displacements which the cutting edge undergoes on continuous penetration between the toothed rings on both sides resiliently pressed against each other in the rolling operation is sufficient to impart to it an adequate sharpening in the course of a few reciprocal movements. Moreover, the sharpening is more durable than the aforementioned conventional sharpenings. This face is due to the grinding tracks extending perpendicularly to the cutting, as is also the case with the sharpening carried out in the factory.

It has been found particularly expedient to make the two toothed rings separately from the rollers. The rollers are usually formed of plastic, and the toothed rings are usually formed from a ceramic grinding material. For instance, the toothed ring may be formed from aluminum oxide or from metal which is given a coating of a grinding material suitable for this purpose.

BRIEF DESCRIPTION OF THE DRAWINGS

A preferred embodiment of the invention will be described in detail hereinafter with the aid of the drawings, wherein.

DESCRIPTION OF THE PREFERRED EMBODIMENT

Figure 1:
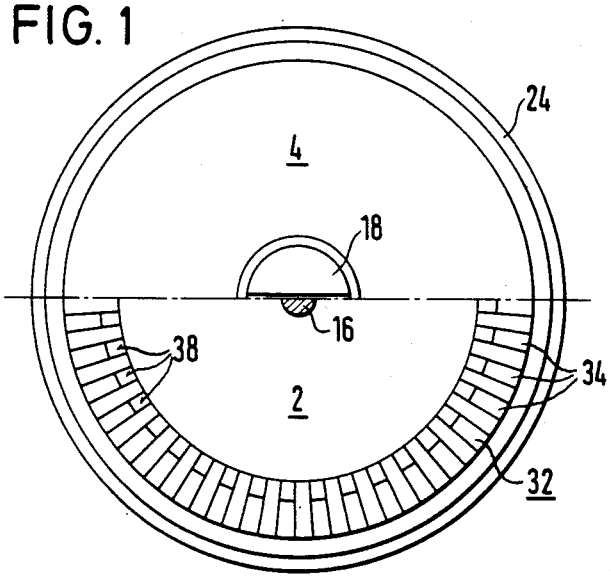
FIG. 1 shows in its upper half a front elevation of a preferred embodiment of the knife sharpener and in its lower half the rear part thereof.
Figure 2:
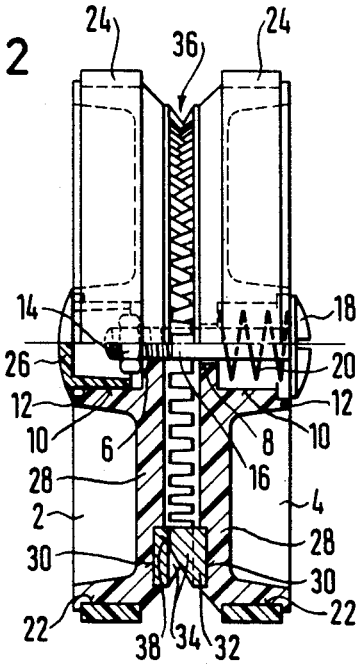
FIG. 2 shows in its upper half a side elevation and in the lower half a central longitudinal section through the knife embodiment of the sharpener shown in FIG. 1.

The knife sharpener shown in the figures has two substantially identical rollers 2 and 4 which are made from plastic and which differ only in that the roller 2 has in its center a threaded bore 6 while the roller 4 a somewhat wider cylindrical bore 8. Towards the outside the bores 6 and 8 are followed by a further blind hole 10 which has at its end a further annular widening 12. Screwed into the threaded bore 6 is a screw bolt 16 which is fixed by a counter nut 14 and on which the roller 4 is mounted by means of its cylindrical bore 8 so as to be axially displaceable and slightly tiltable. The screw bolt 16 has a head 18 which is flat at the lower side and which can be accommodated in the annular widening 12. The blind hole 10 of the roller 4 accommodates a coil spring 20 which tends to press the roller 4 against the roller 2. At their peripheries the rollers 2 and 4 each have a shallow groove 22 into which a rectangularly profiled rubber band 24 is inserted as friction covering. The blind hole 10 of the roller 2 is closed by a resilient plug cap 26.

As is apparent, the two rollers 2 and 4 are disposed in mirror symmetry. Although for saving material and weight they are hollowed on the outside, at the level of the bores 6 and 8 they have a continuous wall 28. In this wall, in the vicinity of the periphery thereof, in each case a shallow rectangular profiled annular groove 30 is provided which accommodates a separate toothed ring 32. The two identical toothed rings 32 are adhered to the respective roller. Each ring 32 has about 25 teeth with which the two rings intermesh. The peripheries of the toothed rings are conically formed so that a V-shaped gap 36 results between the two toothed rings. The two toothed rings 32 either consist entirely of a ceramic grinding material to containing aluminium oxide and/or silicon carbide or alternatively are formed of metal which is provided at least on the conical periphery and the oppositely directed end faces 38 with a permanent grinding material coating. Such a coating may contain, for example, about 20% tungsten carbide, 40% silicon carbide, and 40% of a ceramic binder onto which a hard chromium coating has been applied. The tips and edges of the carbide crystals appear through the hard chromium coating and exert an excellent grinding action. However, the remains coating very durable and is also relatively cheap to produce.

In use the knife sharpener described above is placed on a planar support or base, for example the top of a table, whereupon the knife blade to be sharpened is introduced from above through the V-shaped gap 36 between the two toothed rings 32. Thereby the two toothed rings together with the adjoining rollers 2 and 4 are pressed in the respective region somewhat apart, at the most until the head 18 of the screw bolt 16 comes to bear on the bottom of the annular widening 12 (the bolt is correspondingly set). In this manner the knife blade is given a secure guiding. When the knife blade is now passed parallel to the support over the latter, the blade sharpener rolls on the support, and the end faces 38 of the toothed rings 32 moving in grinding manner along the flanks of the knife blade. In this manner, it is possible to obtain rapidly and reliably a substantially sharper grind than for instance by means of the knife sharpener referred to at the beginning. However, the knife sharpener described is just as light and easy to handle and requires no fixed mounting.

I claim:

1. A rollable knife sharpener in which the grinding takes place in a direction which is predominantly normal to the cutting edge of the knife, said rollable knife sharpener comprising:

(a) a first roller which is symmetrical about a rolling axis and which has an inside axial surface and an outside axial surface, said first roller having a threaded axial bore extending from its inside axial surface part way therethrough and a first blind bore which is larger in diameter than said threaded bore, which is coaxial with said threaded bore, and which extends from said threaded bore to the outside axial surface of said first roller;

(b) a second roller which is symmetrical about a rolling axis which is coincident with the rolling axis of said first roller, said second roller having the same radial dimensions as said first roller, said second roller having an inside axial surface facing the inside axial surface of said first roller and an outside axial surface, said second roller having a cylindrical axial bore which is larger in diameter than said threaded axial bore in said first roller and which extends from the inside surface of said second roller part way through said second roller and a second blind bore which is larger in diameter than said cylindrical axial bore, which is coaxial with said threaded axial bore, and which extends from said cylindrical axial bore to the outside axial surface of said second roller;

(c) a shaft comprising a threaded first portion threadably received in said threaded axial bore, an unthreaded second portion received in said cylindrical axial bore and said second blind bore, and a head which bears against the outside axial surface of said second roller, the threaded engagement between said threaded first portion of said shaft and said threaded axial bore and the contact of said head with the outside axial surface of said second roller limiting relative axial movement of said first and second rollers, said unthreaded second portion of said shaft being smaller in diameter than said cylindrical axial bore, thereby permitting tilting movement between said shaft and said second roller;

(d) a plug cap closing the axially outer end of said first blind bore;

(e) two substantially coaxially disposed, equally sized toothed rings disposed coaxially between said first and second rollers, one of said toothed rings being mounted on the inner axial surface of said first roller and the outer one of said toothed rings being mounted on the inner axial surface of said second roller, each of said two toothed rings having a large number of generally axially projecting teeth which are sized, shaped, and positioned to intermesh with the teeth on the other one of said two toothed rings, the radially outer peripheries of the teeth on said toothed rings forming a V-shaped gap sized and shaped to receive a knife blade to be sharpened by the rolling movement of said first and second rollers, at least the working surface of the V-shaped gap being formed of a grinding material; and (f) a compression spring disposed in said second blind bore and bearing again said head of said shaft and said second roller, said compression spring serving to bias said two toothed rings resiliently towards each other, whereby:

(g) when the sharpener is placed on a planar support and a knife blade is introduced into the V-shaped gap between said two toothed rings, said first and second rollers tilt slightly relative to each other and are forced somewhat apart against the resilient force of said compression spring and the knife blade is firmly gripped between said two toothed rings, and (h) when said first and second rollers are rolled on the planar support, said teeth are caused to grind the knife blade in a direction which is predominantly normal to the cutting edge of the knife blade, thereby cutting minute gouges on each side of the knife blade in the direction perpendicular to its edge.

2. Knife sharpener according to claim 1, characterized in that each of the two toothed rings has between 15 and 60 teeth.

3. Knife sharpener according to claim 2, characterized in that each of the two toothed rings has 25 teeth.

4. Knife sharpener according to claim 2, characterized in that the two toothed rings are formed of a ceramic grinding material.

5. Knife sharpener according to claim 4, characterized in that the two toothed rings are formed of a ceramic grinding material containing a grinding compound selected from the group consisting of aluminum oxide and silicon carbide.

6. Knife sharpener according to claim 2, characterized in that the two toothed rings are formed of metal coated with a grinding material.

7. Knife sharpener according to claim 6, characterized in that the coating of grinding material comprises a layer having the composition 10 to 30% tungsten carbide, 20 to 50% silicon carbide, and 30 to 50% a ceramic binder.

8. Knife sharpener according to claim 7 characterized in that the coating of grinding material comprises a layer having a composition of about 20% tungsten carbide, about 40% silicon carbide, and about 40% of a ceramic binder, to which a hard chromium layer has been applied.

9. Knife sharpener according to claim 1, characterized in that each of the two rollers is made of plastic and has at its periphery a friction covering.

10. Knife sharpener according to claim 9 wherein the friction covering is formed of rubber.

11. A rollable knife sharpener as recited in claim 1:

(a) wherein said threaded shaft extends into said first blind bore and (b) further comprising a nut threaded onto said threaded shaft and bearing against said first roller.

12. A rollabale knife sharpener as recited in claim 1 wherein:

(a) said first blind bore has a first annular widening at the outside axial surface of said first roller and (b) said plug cap is received in said first annular widening.

13. A rollable knife sharpener as recited in claim 1 wherein:

(a) said second blind bore has a second annular widening at the outside axial surface of said second roller and (b) said head is received in said second annular widening.

14. A rollable knife sharpener as recited in claim 1 wherein:

(a) a first shallow groove is formed in the periphery of said first roller and (b) a second shallow groove is formed in the periphery of said second roller and further comprising (c) a first rectangularly profiled rubber band inserted into said first shallow groove as friction covering and (d) a second rectangularly profiled rubber band inserted into said second shallow groove as friction covering.

15. A rollable knife sharpener as recited in claim 1 wherein the profile of said teeth are slightly curved in the radial direction.

16. A rollable knife sharpener in which the grinding takes place in a direction which is predominantly normal to the cutting edge of the knife, said rollable knife sharpener comprising:

(a) a first roller which is symmetrical about a rolling axis and which has an inside axial surface and an outside axial surface, said first roller having a first axial bore extending from its inside axial surface part way therethrough and a first blind bore which is larger in diameter than said first axial bore, which is coaxial with said first axial bore, and which extends from said first axial bore to the outside axial surface of said first roller;

(b) a second roller which is symmetrical about a rolling axis which is coincident with the rolling axis of said first roller, said second roller having the same radial dimensions as said first roller, said second roller having an inside axial surface facing the inside axial surface of said first roller and an outside axial surface, said second roller having a second axial bore extending from its inside axial surface part way therethrough and a second blind bore which is larger in diameter than said second axial bore, which is coaxial with said second axial bore, and which extends from said second axial bore to the outside axial surface of said second roller;

(c) a shaft comprising a threaded first portion received in said first blind bore, a second portion received in said first and second axial bores, and a head which bears against the outside axial surface of said second roller, said second portion of said shaft being smaller in diameter than at least one of said first and second axial bores, thereby permitting tilting movement between said shaft and at least one of said roller;

(d) a plug cap closing the axially outer end of said first blind bore;

(e) a nut threaded onto said threaded first portion of said shaft and bearing against said first roller, the threaded engagement between said threaded first portion of said shaft and said nut and the contact of said head with the outside axial surface of said second roller limiting relative axial movement of said first and second rollers;

(f) two substantially coaxially disposed, equally sized toothed rings disposed coaxially between said first and second rollers, one of said toothed rings being mounted on the inner axial surface of said first roller and the other one of said toothed rings being mounted on the inner axial surface of said second roller, each of said toothed rings having a large number of generally axially projecting teeth which are sized, shaped, and positioned to intermesh with the teeth on the other one of said toothed rings, the radially outer peripheries of the teeth on said toothed rings forming a V-shaped gap sized and shaped to receive a knife blade to be sharpened by the rolling movement of said first and second rollers, at least the working surface of the V-shaped gap being formed of a grinding material; and (g) a compression spring disposed in said second blind bore and bearing against said head of said shaft and said second roller, said compression spring serving to bias said toothed rings resiliently towards each other, whereby:

(h) when the sharpener is placed on a planar support and a knife blade is introduced into the V-shaped gap between said toothed rings, said rollers tilt slightly relative to each other and are forced somewhat apart against the resilient force of said compression spring and the knife blade is firmly gripped between said toothed rings, and (i) when said first and second rollers are rolled on the planar support, said teeth are caused to grind the knife blade in a direction which is predominantly normal to the cutting edge of the knife blade, thereby cutting minute gouges on each side of the knife blade in the direction perpendicular to its edge.

17. A rollable knife sharpener as recited in claim 16 wherein:

(a) said first blind bore has a first annular widening at the outside axial surface of said first roller;

(b) said plug cap is received in said first annular widening;

(c) said second blind bore has a second annular widening at the outside axial surface of said second roller; and (d) said head of said shaft is received in said second annular widening.

18. A rollable knife sharpener as recited in claim 16 wherein:

(a) a first shallow groove is formed in the periphery of said first roller and (b) a second shallow groove is formed in the periphery of said second roller and further comprising:

(c) a first rectangularly profiled rubber band inserted into said first shallow groove as friction covering; and (d) a second rectangularly profiled rubber band inserted into said second shallow groove as friction covering.

19. A rollable knife sharpener as recited in claim 16 wherein the profile of said teeth are slightly curved in the radial direction.

20. A rollable knife sharptener as recited in claim 16 wherein said second portion of said shaft is smaller in diameter than said second axial bore, thereby permitting tilting movement between said shaft and said second roller.

* * * * *